US006030936A

United States Patent [19]

Lu et al.

[11] Patent Number: 6,030,936

[45] Date of Patent: Feb. 29, 2000

[54] BLOOMING TYPE DISINFECTING CLEANING COMPOSITIONS

[75] Inventors: Robert Zhong Lu, Hasbrouck Heights; Andrew Arno Kloeppel, Mahwah, both of N.J.

[73] Assignee: Reckitt & Colman Inc., Wayne, N.J.

[21] Appl. No.: 08/971,607

[22] Filed: Nov. 17, 1997

[30] Foreign Application Priority Data

Jan. 6, 1997 [GB] United Kingdom ..... 9700140

[51] Int. Cl.[7] ..... C11D 1/72; C11D 1/88; C11D 1/94

[52] U.S. Cl. ..... 510/424; 510/191; 510/199; 510/238; 510/391; 510/423; 510/427; 510/432; 510/433; 510/504; 510/499

[58] Field of Search ..... 510/191, 199, 510/238, 391, 423, 424, 427, 432, 433, 504, 499

[56] References Cited

U.S. PATENT DOCUMENTS

| | | | |
|---|---|---|---|
| 4,013,576 | 3/1977 | Loshaek | 252/106 |
| 4,158,644 | 6/1979 | Hammerel | 252/547 |
| 4,540,505 | 9/1985 | Frazier | 252/106 |
| 4,769,169 | 9/1988 | Fishlock-Lomax | 252/106 |
| 5,288,335 | 2/1994 | Stevens | 134/38 |
| 5,691,289 | 11/1997 | Purcell et al. | 510/174 |

FOREIGN PATENT DOCUMENTS

| | | | |
|---|---|---|---|
| 1120820 | 3/1982 | Canada | C11D 3/38 |
| 0 691 397 A2 | 1/1996 | European Pat. Off. | C11D 3/00 |
| 2 304 111 | 3/1997 | United Kingdom | C11D 3/48 |
| 2 304 112 | 3/1997 | United Kingdom | C11D 3/48 |
| 2 304 115 | 3/1997 | United Kingdom | C11D 3/48 |
| WO 97/06230 | 2/1997 | WIPO | C11D 1/65 |

OTHER PUBLICATIONS

Copy of GB Search Report dated Mar. 14, 1997 for GB Application No. 9700140.8.

Copy of PCT Search Report dated Mar. 11, 1998 for PCT Application No. PCT/US97/21108.

Copy of Database WPI, Section Ch, Week 9231, Class A97, An 92–255795, No. XP002056385 & JP 04 173 900 A.

*Primary Examiner*—Yogendra N. Gupta
*Assistant Examiner*—Gregory R. Delcotto
*Attorney, Agent, or Firm*—Fish & Richardson P.C.

[57] ABSTRACT

A blooming type, germicidal hard surface cleaning and disinfecting concentrate compositions according to the invention comprise the following constituents:

0.1–10% wt. of a terpene containing solvent which desirably includes both pine oil and d-limonene;

0.1–12% wt. of at least one organic solvent;

0.1–20% wt. at least one non-ionic surfactant constituent which desirably includes at least one nonionic surfactant having an HLB of greater than or equal to 10, and at least one nonionic surfactant having an HLB value of less than or equal to 8;

a bloom enhancing effective amount at least one amphoteric surfactant selected from alkylampho(mono)- and (di)-acetates, alkylampho(mono)- and (di)-propionates, and aminopropionates;

optionally a further nonionic surfactant based on a $C_8$–$C_{18}$ primary alcohol ethoxylate which exhibits a cloud point of 20° C. in water;

a germicidally effective amount of at least one cationic surfactant having germicidal properties; and, the balance, to 100% wt. of water.

The concentrate compositions may comprise from 0–20% of further optional additives.

In particularly preferred embodiments the concentrate compositions may be characterized in that when the concentrate compositions are diluted at a ratio of 1 part to 64 parts water at 20° C. or 40° C. the resultant mixture exhibits a good light transmittance loss.

The concentrate compositions provide good blooming characteristics when diluted in water to form cleaning and disinfecting compositions therefrom.

11 Claims, No Drawings

BLOOMING TYPE DISINFECTING CLEANING COMPOSITIONS

The present invention relates to improvements in cleaning compositions. More particularly, the present invention is directed to improved blooming type cleaning compositions and concentrates thereof, which find particular use in hard surface cleaning and/or disinfecting applications.

Cleaning compositions are commercially important products and enjoy a wide field of utility in assisting in the removal of dirt and grime from surfaces, especially those characterized as useful with "hard surfaces". One particular category of cleaning compositions are those which provide a "blooming" effect. Such an effect may be described as the change of the water's appearance from essentially colorless and transparent to that of a milky white or milky yellowish white, cloudy appearance upon the addition of an amount of the cleaning composition. This effect is also sometimes referred to as the "break". Such blooming is a highly desirable in such pine oil type cleaning compositions as consumer/end user expectations associate cleaning effectiveness with the extent and degree of this blooming upon formation of a cleaning composition. Such an effect is particularly known and generally associated with pine oil type cleaning compositions which typically include one or more of the following identifying characteristics: containing an amount of one or more resins or oils derived from coniferous species of trees; containing natural fragrances or synthetic fragrance compositions which are intended to mimic the scent of one or more resins or oils derived from coniferous species of trees; a color ranging from colorless to a deep amber, deep amber yellow or deep amber reddish color; generation of a milky or cloudy appearance when diluted with water in dilutions useful for cleaning applications. Such pine oil type cleaning compositions are generally provided in a concentrated composition which is subsequently diluted with water by an end user/consumer to form a cleaning composition therefrom.

A further popular and useful material which is found in cleaning compositions are materials based on citrus fruit extracts, particularly d-limonene. Such provide a pleasant scent to consumers, provide useful solubilization of stains, but are not usually associated with blooming type compositions.

While such pine oil type cleaning compositions are commercially significant and in popular use, their use is not without attendant shortcomings. For example, high levels of pine oil in a cleaning composition are known to be good cleaning agent, and to provide a pleasant scent to a cleaning composition, pine oils also are known to leave undesirable surface residues, particularly on hard surfaces. One or more of these undesirable effects may be minimized by reducing the amount of pine oil in a composition, but such a reduction reduces the cleaning efficacy of a cleaning composition, as well as the scent, both frequently highly desirable characteristics. Further, pine oil, while known to have cleaning efficacy is not generally considered useful as a broad spectrum antibacterial or sanitizing agent, which is also frequently desired property in such pine oil type cleaning compositions. Additionally, pine oil type cleaning compositions generally have a pronounced and often pungent scent which is not universally popular to consumers.

To address one or more of these shortcomings various formulations directed to the production of pine oil type cleaners with reduced pine oil content have been proposed. These include for example, CA 1153267 and CA 1120820, as well as currently copending and commonly assigned U.S. Pat. No. 5,591,708 which teaches pine oil type cleaning compositions which include reduced amounts of pine oil, but which only teach the use of certain germicidal cationic surfactant compositions as optional constituents. Further is commonly assigned U.S. Pat. No. 5,629,280 which teaches pine oil type cleaning compositions which feature germicidal activity but which do not teach the inclusion of large percentages of a fragrance and/or fragrance solubilizer constituent. Such constituents fragrance constituents are generally organic compounds and would be expected to have a significant potential to detract or eliminate the blooming behavior taught in that specification. While these above recited compositions may be advantageous in certain respects, these compositions as well as other art known compositions and formulations are not without attendant shortcomings, which shortcomings the present applicant addresses.

It is therefore among the objects of the invention to provide cleaning compositions and concentrates thereof which exhibit at least one, but preferably two or more of the following features: good cleaning efficacy, satisfactory "blooming" behavior and a satisfactory germicidal effect.

It is further object of the invention to provide commercially acceptable shelf stable concentrated blooming type cleaning and disinfecting concentrate composition which exhibits a good blooming effect, yet contains d-limonene and a reduced amount of pine oil, which concentrated cleaning compositions are readily dilutable with water to form useful cleaning compositions.

A further object of the invention is the provision of aqueous cleaning and disinfecting compositions.

These and other objects of the invention will become apparent from the following detailed description of the invention.

The blooming type, germicidal hard surface cleaning and disinfecting concentrate compositions according to the invention comprise the following constituents:

- 0.1–10% wt. of a terpene containing solvent which desirably includes both pine oil and d-limonene;
- 0.1–12% wt. of at least one organic solvent;
- 0.1–20% wt. at least one non-ionic surfactant constituent which desirably includes at least one nonionic surfactant having an HLB of greater than or equal to 10, and at least one nonionic surfactant having an HLB value of less than or equal to 8;
- a bloom enhancing effective amount at least one amphoteric surfactant selected from alkylampho(mono)- and (di)-acetates, alkylampho(mono)- and (di)-propionates, and aminopropionates;
- optionally a further nonionic surfactant based on a $C_8$–$C_{18}$ primary alcohol ethoxylate which exhibits a cloud point of 20° C. in water;
- a germicidally effective amount of at least one cationic surfactant having germicidal properties; and,
- the balance, to 100% wt. of water.

According to certain especially preferred embodiments, the concentrate compositions may be characterized in that when the concentrate compositions are diluted at a ratio of 1 part to 64 parts water at 20° C. or 40° C. the resultant mixture exhibits a light transmittance loss of at least 50%.

In addition to the above described constituents, the compositions according to the invention may optionally further include known art additives especially coloring agents, fragrances, and thickening agents in conventional amounts. These may comprise from 0 to 20% wt. of the concentrate compositions, preferably from 0–10% wt., and most preferably from 0–5% wt.

The inventors have found that it is now possible to produce certain concentrate compositions utilizing these selected constituents in particular formulations which provide germicidal cleaning compositions which exhibit many of the desirable characteristics of pine oil type cleaning compositions described above, especially "blooming", notwithstanding the relatively low levels of pine oil constituents. That such behavior is achieved in the compositions having such low levels of pine oil constituents which have been associated with the cause of the blooming behavior is surprising to say the least.

In particularly preferred embodiments the concentrate compositions do not form a gel at usual storage conditions (room temperature, approx. 20° C.), and exhibit a satisfactory blooming effect when added to a larger volume of water where such water is either at room temperature or at a higher temperature, particularly at approx. 40° C. According to preferred embodiments, the concentrate compositions cause a drop in transmitted light through water of at least 20%, more desirably at least about 30% and more when used to form a cleaning composition therefrom, particularly at a dilution of 1 part cleaning concentrate to 64 parts water relative to the transmittance of water, which is established to be 100%. According to particularly preferred embodiments the concentrate compositions cause a drop in transmitted light through water of at least about 40% when added to water at 40° C., and also cause a drop in transmitted light through water of at least 30%, more desirably at least 40%, when added to water at 20° C. Most preferred are compositions which exhibit a drop in transmitted light of at least 60% when added to water at 20° C., and which exhibit a drop in transmitted light of at least 70% when added to water at 40° C. wherein the dilutions of concentrate composition to water is 1:64.

The blooming type, germicidal hard surface cleaning and disinfecting compositions according to the invention comprise a terpene containing solvent constituent, which preferably includes a pine oil constituent, or a derivative fraction thereof. Pine oil is an organic solvent, and is a complex blend of oils, alcohols, acids, esters, aldehydes and other organic compounds. These include terpenes which include a large number of related alcohols or ketones. Some important constituents include terpineol, which is one of three isomeric alcohols having the basic molecular formula $C_{10}H_{17}OH$. One type of pine oil, synthetic pine oil, will generally have a specific gravity, at 15.5° C. of about 0.9300, which is lower than the two other grades of pine oil, namely steam distilled and sulfate pine oils, and will generally contain a higher content of turpentine alcohols. Other important compounds include alpha- and beta-pinene (turpentine), abietic acid (rosin), and other isoprene derivatives.

Particularly effective pine oils which are presently commercially available include those commercially marketed under the tradenames Unipine® (Union Camp) or Glidco®, (Glidco Orgnics Corp.). These commercially available pine oils are available in a variety of grades which typically contain approximately 60% to 100% terpene alcohols, especially alpha-terpineol. Other products which can contain up to 100% pure alpha-terpineol, may also be used in the present invention. Desirably the pine oil constituent includes at least about 60% wt. terpineol, and more preferably includes even higher amounts of terpineol.

The terpene containing solvent constituent, further also preferably includes one or more further terpene based solvents. These terpene containing solvents preferably include mono- and bicyclic monoterpenes, i.e., those of the hydrocarbon class, which include, for example, the terpinenes, terpinolenes, limonenes, pinenes and mixtures thereof. Particularly preferred terpenes include d-limonene, and the mixture of terpene hydrocarbons obtained from the essence of oranges, e.g., cold-pressed orange terpenes and orange terpene oil phase ex fruit juice, and the mixture of terpene hydrocarbons expressed from lemons and grapefruit. The foregoing terpene hydrocarbon solvents are include derivatives of citrus fruits and citrus fruit by-products and, therefore, are naturally occurring materials. Numerous other terpene hydrocarbons are known to those skilled in the art and may be used to prepare the blooming type, germicidal hard surface cleaning and disinfecting compositions of the present invention; however, those as mentioned above recited which are based on d-limonene and the mixture of terpene hydrocarbons obtained from citrus fruits are the most readily available and, hence, are preferred. Of these d-limonene is the most preferred.

These terpene containing solvent constituents are typically supplied as technical grade materials which may be and are often formulated with small amounts, e.g., 0.1% wt. (weight percent,) of auxiliary materials such as one or more stabilizers, e.g., antioxidants such as butylated hydroxytoluene. Such auxiliary materials are included within the meaning of the term "terpene containing solvent", as employed in this specification and the accompanying claims. It is also to be understood that mixtures of two or more terpene containing solvents constituents may also be used to form the terpene containing solvent in the compositions according to the invention.

The terpene containing solvent constituent may be present in the concentrate compositions in amounts of from about 0.1% by weight to up to about 10% by weight, preferably in amounts of up to about 1–8% by weight, but most preferably in amount of between 2–6% pine oil by weight. As with all of the weight percentages of the constituents described, the weight percentages are indicative of the weight percentages of the actives in a constituent containing preparation. Desirably the terpene containing solvent constituent in the inventive compositions are mixtures of pine oil or specific pine oil fractions such as alpha-terpineol, and d-limonene.

More desirably the amount of d-limonene present and the amount of pine oil or fraction thereof are in specific weight proportions, such that the weight ratio proportion of pine oil or fraction thereof:d-limonene or fraction thereof is in the range of 3–0.5:1, but preferably are in the weight ratio range of 2–0.5:1. Most desirably the pine oil or fraction thereof is present in equal amounts to the d-limonene or in a slight excess, especially in a weight ratio range of pine oil or fraction thereof:d-limonene of 1–1.25:1.

The compositions according to the invention contains at least one organic solvent. This organic solvent assists in improving the dispersability and/or miscibility of the water insoluble terpene containing solvent in water. This organic solvent also desirably contributes to the dispersability and/or miscibility of further constituents according to the present invention, including any water insoluble or poorly soluble constituents including certain alcohol ethoxylates, and fragrances each of which are described in more detail below. Many useful organic solvent which are known to be useful in dispersing pine oil and citric oil or fractions thereof in water may be utilized. Many of these organic solvents are also known to provide good detersive action and/or good solubilization of greases and fats which may be found in many surface soils. Any organic solvent which is demonstrated to be exhibit effective solubilization of the terpene containing constituent and which do not undesirably detract from the other features of the present invention, particularly the blooming characteristics as well as the sanitization characteristics of the invention may be used. Mixtures of two or more organic solvents may also be used.

Exemplary useful organic solvents include $C_1$–$C_8$ alcohols, especially $C_1$–$C_3$ alcohols, of which isopropanol is preferred. Such alcohols provide effective solubilization of many types of greases and fats which may be encountered in soils, as well as being useful in the solubilization of the preferred pine oil or fractions thereof and d-limonene in water, without substantially interfering with the blooming and scent characteristics of the compositions according to the present invention. Of course two or more organic solvents may be used as the organic solvent constituent according to the invention.

It is also particularly desirable that one or more organic solvents selected have minimal odor as such is undesirable from a consumer acceptance standpoint.

Particularly useful organic solvents include certain glycols and glycol ethers which exhibit the above described properties. Examples of such glycol ethers include those having the general structure $R_9$—O—$R_{10}$—OH, wherein $R_9$ is an alkoxy of 1 to 20 carbon atoms, or aryloxy of at least 6 carbon atoms, and $R_{10}$ is an ether condensate of propylene glycol and/or ethylene glycol having from one to ten glycol monomer units. Examples of such useful glycol ethers include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. Such glycol ethers are presently commercially available from a number of sources. More preferably employed as the organic solvent are one or more glycol ethers of the group consisting of ethylene glycol n-butyl ether, diethylene glycol n-butyl ether, and mixtures thereof. A particularly useful organic solvent which exhibits good detersive effects as well as good solubilization of pine oil in water is diethylene glycol n-butyl ether [also recognized by the names 2-(2-butoxyethoxy)ethanol, butoxydiglycol and diethylene glycol monobutyl ether] having the formula: $C_4H_9OCH_2CH_2OCH_2CH_2OH$, as available for example in the DOWANOL™ glycol ether series (most preferably as DOWANOL DB diethylene glycol n-butyl ether) available from The Dow Chemical Company, Midland Mich., or as Butyl CARBITOL™ from Union Carbide.

While the exact amount of the organic solvent required may vary from composition to composition, it has generally been found the addition of only a minimum effective amount which is found to be effective in dispersing or solubilizing terpene containing solvents constituent and optionally any other aqueous insoluble or poorly soluble constituents in the concentrate compositions is desirably used, although such are observed to improve the stability of the concentrate compositions at elevated temperatures, i.e., 40° C. It is nonetheless desirable to reduce the amount of volatile organic constituents in the concentrate compositions of the invention, which volatile organic constituents are desirably minimized from an environmental standpoint. The present inventors have found that inclusion of the organic solvent in amounts from about 0.1–8% wt. according have been found to be particularly effective to solubilize the terpene containing solvent, as well as in solubilizing other less water soluble constituents present in the concentrate compositions of the invention. Yet more preferably, the organic solvent is present in amounts of 1–8% by weight, and most preferably 5–7% by weight in the concentrate compositions of the invention.

The concentrate compositions according to the invention further include at least one nonionic surfactant constituent, and desirably includes at least one nonionic surfactant having an HLB of greater than or equal to 10, and at least one nonionic surfactant having an HLB value of less than or equal to 8.

Generally, suitable nonionic surface active agents which may be used in the nonionic surfactant system according to the invention includes condensation products of one or more alkylene oxide groups with an organic hydrophobic compound, such as an aliphatic or alkyl aromatic compound. Exemplary suitable nonionic surface active agents include surfactant compositions based upon polyethoxylated, polypropoxylated, or polyglycerolated alcohols, alkylphenols or fatty acids.

One exemplary class of nonionic surfactants useful in the compositions according to the instant invention include certain alkoxylated linear aliphatic alcohol surfactants which are believed to be the condensation products of a alkyl hydrophilic moiety with polyethylene oxide/polypropylene oxide moieties. Such alkoxylated linear alcohol surfactants are presently commercially available under the tradename PolyTergent® (Olin Chemical Co., Stamford Conn.). Particularly useful are those which are marketed as PolyTergent® SL-22 which is reported to have an HLB (hydrophobic-lipophobic balance) value of 6.6, PolyTergent® SL-42 which is reported to have an HLB value of 8.8, and PolyTergent® SL-62 which is reported to have an HLB value of 10.8. These alkoxylated linear alcohol surfactants do not tend to form a gel phase in a aqueous system such as the present invention provides, and also provide good detersive action in the removal of many types of fats and greases such as are frequently found in soils on hard surfaces. These alkoxylated linear alcohol surfactants as well as provide further solubilizing effect for the pine oil and d-limonene, and may be included in the concentrate compositions according to the present invention with advantage.

Also useful are alkoxylated alcohols include certain ethoxylated alcohol compositions presently commercially available from the Shell Chemical Company, (Houston, Tex.) under the general trade name Neodol® particularly those which exhibit the HLB values discussed above. Further useful exemplary alkoxylated alcohols further include certain compositions presently commercially available from the Union Carbide Co., (Danbury, Conn.) under the general trade name Tergitol®, which are described to be secondary alcohol ethoxylates. Also useful in the nonionic surfactant constituent include alkoxylated alkyl phenols presently commercially available from the Rhône-Poulenc Co., (Cranbury, N.J.) under the general trade name Igepal®, which are described to be octyl and nonyl phenols. Other known nonionic surface active agents not particularly enumerated here may also be used. Such exemplary nonionic surface active agents are described in *McCutcheon's Detergents and Emulsifiers,* North American Edition, 1982; *Kirk-Othmer, Encyclopedia of Chemical Technology,* 3rd Ed., Vol. 22, pp. 346–387, the contents of which are herein incorporated by reference.

Desirably the nonionic surfactant system in the concentrate compositions according to the invention comprise a mixture of two or more nonionic surfactants, one of which acts to aid in the solubilization of the other in water. One of the nonionic surfactant constituents is generally selected to be one or more aqueous insoluble or poorly soluble surfactants, while the other nonionic surfactant constituent is generally selected to provide good cleaning efficacy particularly of stains and soils, as well as having a solubilizing effect of the other nonionic surfactant in the concentrated compositions according to the present invention. This a solubilizing effect is important as it aids in the long term shelf stability of prepared concentrated compositions, as well as in ensuring the optical clarity of concentrated compositions particularly during the shelf life of prepared concentrated compositions.

Generally, the use of alkoxylated linear aliphatic alcohol surfactants, such commercially available PolyTergent® series of nonionic surfactants are to be preferred over the use of nonionic surfactants based on alkoxylated secondary alcohols, such as the Tergitol® series, or the alkoxylated alcohols of the Neodol® series, or the alkoxylated phenols such as the Igepal® series of nonionic surfactants. This is due to the fact that in the alkoxylated linear aliphatic alcohol surfactants, especially the preferred materials of the PolyTergent® series of nonionic surfactants do not exhibit gelling at the useful range of the concentrate compositions of the invention. The latter classes of nonionic surfactants recited herein may be used in the inventive compositions, but are less desired as they may form a gel, and/or require a greater amount of an organic solvent to solubilize them sufficiently so as to impede gel formation.

With regard to a nonionic surfactant system according to the invention which comprise a mixture of two or more nonionic surfactants, especially useful are binary mixtures of two similar nonionic surfactants. In such a binary system there is present at least one nonionic surfactant having an HLB of greater than or equal to 10 or desirably even greater. There is also present at least one nonionic surfactant having an HLB of less than or equal to 8. Examples of such binary systems include Tergitol® 15-S-9 with Tergitol® 15-S-3, as well as Neodol® 25-9 with Neodol® 91-2.5. A particularly useful such system of nonionic surfactants is a binary system which includes alkoxylated linear aliphatic alcohol surfactants which are commercially available as PolyTergent® SL-22 which is used in conjunction with PolyTergent® SL-62. Other particularly useful examples are discussed amongst the Examples described below. Most desirably, these nonionic surfactants are present in weight ratios of the at least one nonionic surfactant having an HLB of greater than or equal to 10 to the at least one nonionic surfactant having an HLB value of less than or equal to 8 of 2–3:1 parts by weight.

With regard to the nonionic surfactant constituent according to the invention, in especially preferred embodiments this constituent comprises a mixture of two are alkoxylated linear aliphatic alcohol surfactants. Certain especially preferred embodiments of the nonionic surfactant system in the concentrate compositions of the invention are illustrated in the Examples below.

The one or more nonionic surfactant compounds which comprise the nonionic surfactant constituent may be present in any effective amount, but desirably is present in the concentrate compositions in amounts of from as little as 0.1% by weight to amount of up to about 20% by weight, preferably in amounts of 2 to 18% by weight, but most preferably in amount of between 8% wt. and 15% by weight.

The compositions of the invention require a blooming effective amount of at least a bloom enhancing effective amount at least one amphoteric surfactant selected from alkylampho(mono)- and (di)-acetates, alkylampho(mono)- and (di)-propionates, and aminopropionates. These amphoteric surfactants may be used singly, or in combination with further other amphoteric surfactants, but desirably are the sole amphoteric surfactants present in the compositions. Salt forms of these amphoteric surfactants may also be used.

Exemplary useful alkylampho(mono)acetates include those according to the according to the general structure:

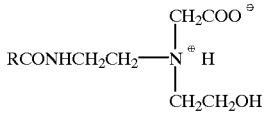

Exemplary useful alkylampho(di)acetates include those according to the according to the general structures:

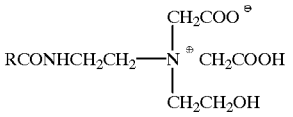

or

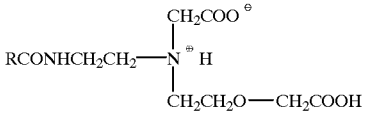

Exemplary useful alkylampho(mono)propionates include those according to the according to the general structure:

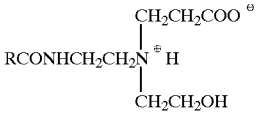

Exemplary useful alkylampho(di)propionates include those according to the according to the general structure:

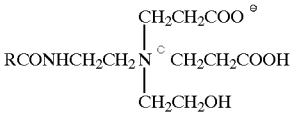

or

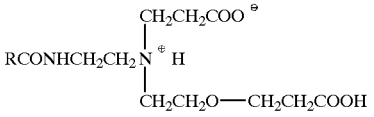

Exemplary useful aminopropionates include those according to the following general structure:

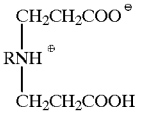

In each of the above indicated structures, R represents a $C_8$ to $C_{24}$ alkyl group and desirably is a $C_{10}$ to $C_{16}$ alkyl group, especially coco derivatives which typically provide a mixture of $C_{10}$, $C_{12}$, $C_{14}$ and $C_{16}$ alkyl groups with a predominance of $C_{12}$ alkyl groups.

Specific examples of particularly useful amphoteric surfactants for the inventive compositions include mono- and di-carboxymethyl derivatives of 1-hydroxyethyl-2-alkylimidazolines, such as cocoamphoacetate, cocoamphodiacetate, cocoamphopropionate and cocoamphodipropionate. These may be in the form of salts, or in a salt free form.

Specific useful and commercially available amphoteric surfactants which may be used in the inventive compositions include certain surfactants presently commercially available under the tradename Miranol® Rhône-Poulenc (Cranbury N.J.). Specific examples include Miranol® C2M-NPLV described to be disodium cocoamphodiacetate; Miranol® FA-NP which is described to be sodium cocoamphoacetate, Miranol® DM described to be sodium stearoamphoacetate; Miranol® HMA described to be sodium lauroamphoacetate; Miranol® C2M described as being cocoamphodiproponic acid; Miranol® C2M-SF described as being disodium cocoamphodipropionate; Miranol® CM-SF Conc. described as being cocoamphopropionate; and Mirataine® H2C-HA described as being sodium lauriminodipropionate. Of these materials, the most preferred for use in the systems according to the invention is disodium cocoamphodiacetate.

Further exemplary and particularly useful commercially available amphoteric surfactants include those available under the tradename Amphoterge® (Lonza Inc., Fair Lawn N.J.) particularly Amphoterge® K described to be sodium cocoamphopropionate, Amphoterge® K-2 described as being disodium cocoamphodipropionate, Amphoterge® W described to be sodium cocoamphoacetate, and Amphoterge® W-2 described to be disodium cocoamphodiacetate. Of these materials, the most preferred for use in the systems according to the invention is disodium cocoamphodipropionate.

It has been observed that with certain amphoteric surfactants based on mono- or di-propionates the inclusion of a further nonionic surfactant which exhibits a cloud point of 20° C. in water frequently advantageously improves the blooming characteristics of the compositions, particularly those which include alkylampho(mono)propionates or alkylampho(di)-propionates.

The cloud point of the further nonionic surfactant may be determined by known methods. For example, ASTM D2024 (reapproved 1986) for "Standard Test method for Cloud Point of Nonionic Surfactants". According to this test method which is particularly useful for nonionic surfactants of a detergent systems which are characterized of less soluble in water at higher temperatures than at lower temperatures wherein the cloud point occurs within water at a temperature range of between 30–95° C. According the test protocol, a one percent test solution is prepared by weighing one gram of the surfactant into a 150 ml. beaker to which 100 mls. of distilled dimineralized water at a temperature of less than 30° C. is added. The sample is agitated until solution is reached, after which a 50 ml. aliquot of the solution is placed into a test tube. While agitating the sample solutions slowly with the thermometer, the test tube is heated with a bunsen burner until the sample solution becomes definitely cloudy, at which point it is removed from the heat. While stirring with the thermometer continues, the test tube and its sample solution are allowed to cool slowly until the sample solution clarifies at which point the temperature is noted. Such a test method provides a simple, yet reliable, means for determining the cloud point of a surfactant in water.

An even simpler test method for effectively determining which nonionic surfactants may be used in the compositions of the invention is as follows: to a clean beaker or other glass vessel is added 99 parts by weight of deionized water at 20° C.±0.5° C., and 1 part by weight (by weight of the actives) of a surfactant composition to be tested. This test sample is stirred and the temperature permitted to drop to 20° C.; if this test sample is observed to be murky or cloudy in appearance as the test sample's temperature achieves 20° C. and drops below 20° C., it is considered to have a suitable cloud point of 20° C. and less and may be used.

Particularly useful are linear $C_8$–$C_{18}$ primary alcohol alkoxylates. Such linear $C_8$–$C_{18}$ primary alcohol alkoxylates, and preferably $C_9$–$C_{12}$ primary alcohol ethoxylates, may have varying degrees of alkoxylatio but desirably include from about 1 to about 12 ethoxy groups per molecule, and more preferably about 1 to about 6 ethoxy groups per molecule. A preferred material is a linear $C_9$–$C_{11}$ primary alcohol ethoxylate having an average of 2.5 ethoxy groups per molecule. Such a material is available as Neodol® 91-2.5 (Shell Co.).

When included, the linear $C_8$–$C_{18}$ primary alcohol alkoxylate may be present in any effective amount to aid in the blooming effect induced or provided by the amphoteric surfactant constituent. When present, exemplary useful amounts are from 0.001% wt. to about 2.5% wt. based on the total weight of the concentrate compositions, and especially effective amounts being from 0.01% wt. to 1% wt.

The amphoteric surfactant constituent may be present in any effective amount, but is/are desirably present in the concentrate compositions in amounts of from as little as 0.1% by weight to amount of up to about 10% by weight, but are preferably present in amounts of from 0.5%–8% by weight.

The compositions and concentrate compositions according to the invention include as a necessary constituent at least one cationic surfactant which is found to provide a useful germicidal effect. Any cationic surfactant which satisfies these requirements may be used and are considered to be within the scope of the present invention, and mixtures of two or more cationic surface active agents, viz., cationic surfactants may also be used. Cationic surfactants are well known, and useful cationic surfactants may be one or more of those described for example in *McCutcheon's Detergents and Emulsifiers,* North American Edition, 1982; *Kirk-Othmer, Encyclopedia of Chemical Technology,* 3rd Ed., Vol. 22, pp. 346–387, the contents of which are herein incorporated by reference.

Preferably the cationic surfactant includes quaternary ammonium germicides which may be characterized by the general structural formula:

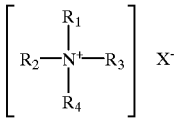

where at least one of $R_1$, $R_2$, $R_3$ and $R_4$ is a hydrophobic, aliphatic, aryl aliphatic or aliphatic aryl group of from 6 to 26 carbon atoms, and the entire cation portion of the molecule has a molecular weight of at least 165. The hydrophobic groups may be long-chain alkyl, long-chain alkoxy aryl, long-chain alkyl aryl, halogen-substituted long-chain alkyl aryl, long-chain alkyl phenoxy alkyl, aryl alkyl, etc. The remaining groups on the nitrogen atoms other than the hydrophobic groups are substituents of a hydrocarbon structure usually containing a total of no more than 12 carbon atoms. The groups $R_1$, $R_2$, $R_3$ and $R_4$ may be straight chained or may be branched, but are preferably straight chained, and may include one or more amide or ester linkages. The group X may be any salt-forming anionic radical.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic group is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

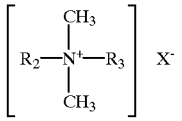

wherein $R_2$ and $R_3$ are the same or different $C_8$–$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a ethosulfate radical. The alkyl groups recited in $R_2$ and $R_3$ may be straight chained or branched, but are preferably substantially linear.

Particularly useful quaternary germicides include compositions which include a single quaternary compound, as well as mixtures of two or more different quaternary compounds. Particularly useful quaternary germicides include BARDAC® 205M, and BARDAC® 208M or BTC® 885 which is described to be a blend of alkyl dimethyl benzyl ammonium chlorides; BARDAC® 2050 and BARDAC® 2080 or BTC® 818 which is described to be based on dialkyl ($C_8$–$C_{10}$)dimethyl ammonium chloride; BARDAC® 2250 and BARDAC® 2280 or BTC® 1010 which is described to a composition which includes didecyl dimethyl ammonium chloride; BARDAC® LF and BARDAC® LF 80 which is described to be based on dioctyl dimethyl ammonium chloride; BARQUAT® MB-50, HYAMINE® 3500, BARQUAT® MB-80, BTC® 835 or BTC 8358 each described to be based on alkyl dimethyl benzyl ammonium chloride; BARQUAT® MX-50, BARQUAT® MX-80, BTC® 824 or BTC® 8248 each described to be a composition based on alkyl dimethyl benzyl ammonium chloride; BARQUAT® OJ-50, BARQUAT® OJ-80, BTC® 2565, or BTC® 2658 each described to be a composition based on alkyl dimethyl benzyl ammonium chloride; BARQUAT® 4250, BARQUAT® 4280, BARQUAT® 4250Z, BARQUAT® 4280Z, BTC® 2125, or BTC® 2125M each described to be a composition based on alkyl dimethyl benzyl ammonium chloride and/or alkyl dimethyl ethyl benzyl ammonium chloride; BARQUAT® MS-100 or BTC® 324-P-100 each described to be based on myristyl dimethyl benzyl ammonium chloride; HYAMINE® 2389 described to be based on methyl dodecyl benzyl ammonium chloride and/or methyl dodecyl xylene-bis-trimethyl ammonium chloride; HYAMINE® 1622 described to be an aqueous solution of benzethonium chloride; HYAMINE® 3500-NF or BTC® 50 each described to be based on alkyl dimethyl benzyl ammonium chloride; as well as BARQUAT® 1552 or BTC® 776 described to be based on alkyl dimethyl benzyl ammonium chloride and/or dialkyl methyl benzyl ammonium chloride. (Each of these recited materials are presently commercially available from Lonza, Inc., Fairlawn, N.J. and/or from Stepan Co., Northfield Ill.).

Mixtures of cationic surfactants may also be use used in forming the cationic constituent according to the present invention.

The cationic surfactant is preferably present in a minimum amount which is effective in providing the desired germicidal and sanitizing effects. Generally, the cationic surfactant present in the concentrate compositions in amounts of up to 5% by weight and less, preferably in amounts of about 3% by weight, but most preferably in an amount of up to about 2% by weight, and most desirably present in an amount of 0.01–2% by weight.

The present inventors have surprisingly overcome various technical prejudices in the relevant art by providing germicidal blooming type concentrates and cleaning compositions as taught herein by the judicious selection of the various constituents as taught herein which notwithstanding the amounts of organic constituents they contain maintain good scent characteristics, good cleaning with a simultaneous sanitizing and germicidal effect and good blooming behavior, particularly when diluted in a larger volume of water to form a cleaning composition therefrom. Further, these compositions are believed to provide low levels of toxicity notwithstanding the amount of the individual volatile organic constituents which they contain, and their individual tendencies to act as irritants to the eyes, skin and mucous tissues.

As the concentrate compositions are aqueous, water forms a major constituent. Water is added in order to provide 100% by weight of the concentrate composition. The water may be tap water, but is preferably distilled and/or deionized water. If the water is tap water, it is preferably appropriately filtered in order to remove any undesirable impurities such as organics or inorganics, especially mineral salts which are present in hard water which may thus interfere with the operation of the other constituents of the invention, as well as any other optional components of the liquid concentrates according to the invention.

Water is added in amounts which are sufficient to form the concentrated compositions which amount is sufficient to ensure the retention of a substantially clear characteristic when produced as a concentrate, but at the same time ensuring good blooming upon the addition of the concentrated composition to a further amount of water, or upon the addition of further water to the concentrate. This amount may be readily determined by first mixing measured amount of the non-water constituents in a suitably sized vessel and then during stirring adding water. Generally, water is present in the concentrate compositions in amounts in excess of about 50% by weight, preferably in amounts of in excess of about 70% by weight, but most preferably in amount of between 70–80% by weight based on the total weight of the concentrate compositions according to the invention.

As noted previously, the concentrate compositions according to the invention may include further optional, but advantageously included constituents.

Useful optional constituents are one or more coloring agents which find use in modifying the appearance of the concentrate compositions and enhance their appearance from the perspective of a consumer or other end user. Known coloring agents, may be incorporated in the compositions in effective amount to improve or impart to concentrate compositions an appearance characteristic of a pine oil type concentrate composition, such as a color ranging from colorless to yellow or yellow/green color with or without fluorescent ingredients. Such a coloring agent or coloring agents may be added in any useful amount in a conventional fashion, i.e., admixing to a concentrate composition or blending with other constituents used to form a concentrate composition. However, other colors atypical of pine oil type and/or lemon oil type cleaning concentrates may be used as well. Known art light stabilizer constituents useful in pine oil type compositions may also be added, particularly wherein coloring agents are used in a composition. As is known to the art, such light stabilizers act to retain the appearance characteristics of the concentrate compositions over longer intervals of time.

A further useful optional constituent of the concentrate compositions according to the invention are fragrances and/or fragrance enhancers which provide a characteristic scent in a concentrate form as well as when diluted to form cleaning compositions therefrom. As is described in the specification under claims, the term "fragrance" is used to refer to and to include any non-water soluble fragrance substance or mixture of such substances including those which are naturally derived (i.e., obtained by extraction of flower, herb, blossom or plant), those which are artificially derived or produced (i.e., mixture of natural oils and/or oil constituents), and those which are synthetically produced substances (odiferous substances). Generally fragrances are complex mixtures or blends various organic compounds including, but not limited to, certain alcohols, aldehydes, ethers, aromatic compounds and varying amounts of essential oils such as from about 0 to about 85% by weight, usually from about 10 to about 70% by weight, the essential oils themselves being volatile odiferous compounds and also functioning to aid in the dissolution of the other components of the perfume. In the present invention, the precise composition of the perfume is of no particular consequence to cleaning performance so long as it may be effectively included as a constituent of the compositions. Of particular note are one or more fragrances characteristic of pine oil type compositions, and one or more fragrances characteristic of citrus fruits in general and lemon, lime and orange fragrances specifically. Such characteristic fragrances may be based on natural derivatives or synthetically produced fragrance compositions. Such fragrances may be added in any conventional manner, admixing to a concentrate composition or blending with other constituents used to form a concentrate composition, in amounts which are found to be useful to enhance or impart the desired scent characteristic to the concentrate composition, and/or to cleaning compositions formed therefrom. Fragrance effects atypical of pine oil and/or citrus fruits may be used as well.

Further useful optional constituents which may in some cases be desirably included in the inventive compositions include rheology modifying agents such as thickeners based on xanthan gum and the like.

Other conventional additives known to the art but not expressly enumerated here may also be included in the compositions according to the invention. By way of non-limiting example these may include pH adjusters, pH buffering agents, foaming agents, further surfactants including anionic, cationic, non-ionic, and amphoteric surfactants, especially those useful in providing further detersive effects, and water softening agents. Such further surfactants denoted here are conventionally known; exemplary compositions are described in *McCutcheon's Detergents and Emulsifiers,* North American Edition, 1982; *Kirk-Othmer, Encyclopedia of Chemical Technology,* 3rd Ed., Vol. 22, pp. 346–387, the contents of which are herein incorporated by reference. Mixtures of two or more such surface active agents may be incorporated into the inventive compositions. Such optional, i.e., non-essential constituents should be selected so to have little or no detrimental effect upon the desirable characteristics of the present invention, namely the blooming behavior, cleaning efficacy, disinfectant activity, and low toxicity as provided by the inventive compositions. Generally the total weight of such further conventional additives may comprise up to 10% by weight of a concentrated composition formulation.

What is to be understood by the term "concentrate" and "concentrate composition" in this specification and claims is the pre-consumer dilution and composition of the cleaning composition which is the essentially the form of the product prepared for sale to the consumer or other end user. Such a consumer or other end user would then normally be expected to dilute the same with water to form a cleaning composition. It is to be understood however that nothing in this invention would bar its use as cleaning composition without any further dilution and it may be used in the concentrations in which it was prepared for sale. Similarly, what is to be understood by the term "cleaning compositions" are the water diluted compositions which are expected to be prepared by the consumer or other end user by mixing a measured amount of the "concentrate" with water in order to form an appropriately diluted cleaning composition which is suitable for use in cleaning applications, especially in the cleaning of hard surfaces.

It is also to be understood, that proportions of one or more constituents have been and generally are referred to as percent by weight or as parts by weight based on a measure of 100% by weight, unless otherwise indicated.

As generally denoted above, the formulations according to the invention include both cleaning compositions and concentrates as outlined above which differ only in the relative proportion of water to that of the other constituents forming such formulations. While the concentrated form of the cleaning compositions find use in their original form, they are more frequently used in the formation of a cleaning composition therefrom. Such may be easily prepared by diluting measured amounts of the concentrate compositions in water by the consumer or other end user in certain weight ratios of concentrate:water, and optionally, agitating the same to ensure even distribution of the concentrate in the water. As noted, the concentrate may be used without dilution, i.e., in concentrate:water concentrations of 1:0, to extremely dilute dilutions such as 1:10,000. Desirably, the concentrate is diluted in the range of 1:0.1–1:1000, preferably in the range of 1:1–1:500 but most preferably in the range of 1:10–1:100. The actual dilution selected is in part determinable by the degree and amount of dirt and grime to be removed from a surface(s), the amount of mechanical force imparted to remove the same, as well as the observed efficacy of a particular dilution. Generally better results and faster removal is to be expected at lower relative dilutions of the concentrate in water.

Compositions according to the invention is exemplified by the examples which include certain particularly preferred embodiments.

EXAMPLE FORMULATIONS

Preparation of Example Formulations

Comparative formulations which are identified by the prefix "C", and exemplary formulations which are identified by the prefix "E" are illustrated on Table 1. Each of these formulations were prepared in accordance with the following general procedure.

Into a suitably sized vessel, the following constituents were added in the following sequence: all or a major amount of the water, pine oil and citrus oil, organic solvent, nonionic surfactants, amphoteric surfactants, germicidal cationic surfactants, any optional constituent, and lastly any remaining water. It is to be noted however that the order of mixing is not critical in order to achieve concentrate compositions exhibiting the desired results. All of the constituents were supplied at as weight percentages, as room temperature, and mixing of the constituents was achieved by the use of a magnetic stirrer. Mixing, which generally lasted from 1 minute to 30 minutes, was maintained until the particular formulation was well mixed.

In the Table, the amounts of the named constituent indicate the amounts of the materials "as is" from the respective supplier. Where the named constituent is supplied at less than "100% wt. actives", the percentage active of the constituent is indicated on Table 2. If not otherwise indicated on Table 2, the percent actives of a named constituent is to be understood to indicate "100% wt. actives".

TABLE 1

| | C1 | C2 | C3 | C4 | C5 | C6 | C7 |
|---|---|---|---|---|---|---|---|
| Pine Oil 1 | 5.0 | 1.0 | 5.0 | 1.0 | 2.0 | 2.0 | 2.0 |
| d-limonene | 5.0 | 2.5 | 5.0 | 2.5 | 6.0 | 6.0 | 6.0 |
| isopropyl alcohol | 5.0 | 5.0 | 12.0 | 12.0 | 3.0 | 3.0 | 3.0 |
| PolyTergent ® SL-62 | 8.0 | 8.0 | 8.0 | 8.0 | 8.0 | 8.0 | 8.0 |
| Neodol ® 91-2.5 | 5.0 | 5.0 | 5.0 | 5.0 | — | 2.0 | 1.0 |
| Alkamide DIN 295/S | 1.5 | 1.5 | 1.5 | 1.5 | 2.0 | — | 1.0 |
| BTC-8358 | 1.0 | 1.0 | 1.0 | 1.0 | 1.0 | 1.0 | 1.0 |
| BTC-818 | 0.5 | 0.5 | 0.5 | 0.50 | 0.5 | 0.5 | 0.5 |
| fragrance | — | — | — | — | 0.2 | 0.2 | 0.2 |
| DI water | 69.00 | 75.50 | 62.00 | 68.50 | 77.50 | 77.50 | 77.50 |
| % light transmittance, 20° C. | gels | gels | strong odor | strong odor | poor bloom | poor bloom | poor bloom |
| % light transmittance, 40° C. | gels | gels | strong odor | strong odor | poor bloom | poor bloom | poor bloom |

| | C8 | C9 | C10 | C11 | C12 | C13 | C14 | C15 | C16 | C17 | C18 | C19 |
|---|---|---|---|---|---|---|---|---|---|---|---|---|
| Pine Oil 1 | 2.5 | 2.0 | 2.0 | 0.5 | 2.5 | 2.5 | 2.5 | 2.5 | 2.5 | 2.5 | 2.5 | 2.5 |
| d-limonene | 0.5 | 6.0 | 6.0 | 2.0 | 2.0 | 2.0 | 2.0 | 2.0 | 2.0 | 2.0 | 2.0 | 2.0 |
| isopropyl alcohol | 3.5 | 3.0 | 3.0 | 4.0 | 4.0 | 3.4 | 3.8 | 3.4 | 3.4 | 3.4 | 3.4 | 3.4 |
| Dowanol ® DB | 1.6 | — | — | 1.5 | 1.4 | 1.6 | 1.5 | 1.6 | 1.6 | 1.6 | 1.6 | 1.6 |
| PolyTergent ® SL-22 | 2.5 | 4.0 | 4.0 | 3.1 | 3.3 | 2.5 | 3.1 | 2.5 | 2.5 | 2.5 | 2.5 | 2.5 |
| PolyTergent ® SL-62 | 7.2 | 8.0 | 8.0 | 9.4 | 9.5 | 7.2 | 9.4 | 7.2 | 7.2 | 7.2 | 7.2 | 7.2 |
| Mirataine ® H2C-HA | — | — | — | — | — | — | — | — | — | 4.0 | — | 8.0 |
| Miranol ® C2M SF | — | — | — | — | — | — | — | — | 8.0 | — | — | — |
| Neodol ® 91-2.5 | 0.28 | — | — | — | — | — | — | 0.28 | — | — | — | — |
| Amphoterge ® K-2 | 4.0 | 1.0 | 5.0 | — | — | 8.0 | — | — | — | — | 4.0 | — |
| Miranol ® C2M NP LV | — | — | — | 3.0 | 1.5 | — | — | — | — | — | — | — |
| BTC-8358 | 1.0 | 1.0 | 1.0 | 1.0 | 1.0 | 1.0 | 1.0 | 1.0 | 1.0 | 1.0 | 1.0 | 1.0 |
| BTC-818 | 0.6 | 0.5 | 0.5 | 0.6 | 0.6 | 0.6 | 0.6 | 0.6 | 0.6 | 0.6 | 0.6 | 0.6 |
| fragrance | 0.25 | 0.2 | 0.2 | 0.25 | 0.25 | 0.25 | 0.25 | 0.25 | 0.25 | 0.25 | 0.25 | 0.25 |
| dye (1% wt.) | 0.2 | — | — | 0.2 | 0.2 | 0.2 | 0.2 | 0.2 | 0.2 | 0.2 | 0.2 | 0.2 |
| DI water | 74.47 | 74.30 | 70.30 | 74.45 | 73.75 | 70.75 | 75.65 | Q.S. | Q.S. | Q.S. | Q.S. | Q.S. |
| % light transmittance, 20° C. | 65.7 | 87.5 | 97.6 | 99.0 | 99.1 | 96.8 | 60.0 | 84.5 | 96.5 | 85.8 | 53.4 | 94.5 |
| % light transmittance, 40° C. | 34.6 | 95.4 | 9.8 | 19.8 | 25.3 | 95.5 | 94.9 | 92.0 | 95.9 | 24.7 | 24.7 | 83.4 |

| | E1 | E2 | E3 | E4 | E5 | E6 | E7 | E9 | E10 | E11 | E12 |
|---|---|---|---|---|---|---|---|---|---|---|---|
| Pine Oil 1 | 2.50 | 2.50 | 2.50 | 2.50 | 2.50 | 2.60 | 5.00 | 2.50 | 2.5 | 2.5 | 2.5 |
| d-limonene | 2.00 | 2.00 | 2.00 | 2.00 | 2.00 | 2.00 | 2.00 | 2.00 | 2.0 | 2.0 | 2.0 |
| isopropyl alcohol | 3.50 | 4.00 | 3.40 | 3.80 | 4.00 | 3.40 | 5.00 | 4.00 | 3.4 | 3.4 | 3.8 |
| Dowanol ® DB | 1.60 | 1.50 | 1.60 | 1.50 | 1.40 | 1.60 | 1.50 | 1.40 | 1.6 | 1.6 | 1.5 |
| PolyTergent ® SL-22 | 2.50 | 3.10 | 2.50 | 3.10 | 3.20 | 3.10 | 3.10 | 3.20 | 2.5 | 2.5 | 3.1 |
| PolyTergent ® SL-62 | 7.20 | 9.40 | 7.20 | 9.40 | 9.50 | 8.90 | 9.40 | 9.50 | 7.2 | 7.2 | 9.4 |
| Mirataine ® H2C-HA | — | — | — | — | — | — | — | — | 4.0 | — | — |
| Miranol ® C2M SF | — | — | — | — | — | — | — | — | — | 4.0 | — |
| Neodol ® 91-2.5 | 0.28 | — | 0.28 | — | — | 0.30 | — | — | 0.5 | — | — |
| Amphoterge K-2 | 4.00 | — | 4.00 | 0.00 | — | 4.00 | — | — | — | — | — |
| Miranol ® C2M NP LV | — | 3.00 | — | 3.00 | 3.50 | — | 3.00 | 3.00 | — | — | 8.0 |
| BTC-8358 | 1.00 | 1.00 | 1.00 | 1.00 | 1.00 | 1.00 | 1.00 | 1.00 | 1.0 | 1.0 | 1.0 |
| BTC-818 | 0.60 | 0.60 | 0.60 | 0.60 | 0.60 | 0.60 | 0.60 | 0.60 | 0.6 | 0.6 | 0.6 |
| fragrance | 0.25 | 0.25 | 0.25 | 0.25 | 0.25 | 0.30 | 0.25 | 0.25 | 0.25 | 0.25 | 0.25 |
| dye (1% wt.) | 0.20 | 0.20 | 0.20 | 0.20 | 0.20 | 0.20 | 0.20 | 0.20 | 0.2 | 0.2 | 0.2 |
| DI water | 74.37 | 72.45 | 74.47 | 72.65 | 71.85 | 72.00 | 68.95 | 72.35 | 74.25 | 74.75 | 67.65 |
| % light transmittance, 20° C. | 33.3 | 38.2 | 21.5 | 38.1 | 26.6 | 38.6 | 29.5 | 50.1 | 36.4 | 30.3 | 15.8 |
| % light transmittance, 40° C. | 21.0 | 23.8 | 25.5 | 25.1 | 20.5 | 19.0 | 20.6 | 23.1 | 20.8 | 26.9 | 17.5 |

The identity of the individual constituents are provided in more detail in Table 2 below.

TABLE 2

| constituent: | identity: |
|---|---|
| Pine Oil 1 | pine oil preparation containing at least about 60% terpene alcohols |
| d-limonene | d-limonene (approx. 95% wt.) |
| isopropyl alcohol | isopropanol |

TABLE 2-continued

| constituent: | identity: |
|---|---|
| Dowanol ® DB | diethylene glycol n-butyl ether from Dow Chemical Co. |
| PolyTergent ® SL-22 | nonionic alkoxylated linear alcohol surfactant recited to have an HLB of 6.6 |
| PolyTergent ® SL-62 | nonionic alkoxylated linear alcohol surfactant recited to have an HLB of 10.8. |
| Mirataine ® H2C-HA | sodium lauriminodipropionate (30% wt.) from Rhone-Poulenc |
| Miranol ® C2M SF | disodium cocoamphodipropionate (39% wt.) from Rhone-Poulenc |
| Neodol ® 91-2.5 | nonionic linear C9–C11 primary alcohol ethoxylate surfactant composition, average of 2.5 ethoxy groups per molecule, from Shell Chemical Co. |
| Amphoterge ® K-2 | amphoteric surfactant based on coconut based imidazoline, dicarboxylate sodium salt (40% wt.) from Lonza Inc. |
| Alkamide ® DIN 295/S | linoleamide diethanol amine (at least 85% wt.) from Rhone-Poulenc |
| Miranol ® C2M NP LV | cocoamphodiacetate (38% wt.) from Rhone-Poulenc |
| BTC-8358 | BTC-8358 is an alkyl benzyl dimethyl ammonium chloride (80% active) available from Stepan Chemical Co. |
| BTC-818 | BTC-818 is a dialkyl dimethyl ammonium chloride (50% active) available from Stepan Chemical Co. |
| dye | proprietary dye composition |
| fragrance (1%) | proprietary fragrance composition, 1% wt. actives |
| DI water | deionized water |

With respect to the formulations of Table 1, the following comments may be made. The formulations according to C1 and C2 were gelled concentrate compositions. The formulations according to C3 and C4 were fluid, but were found to have an offensive smell believed to be attributable to the high content of the isopropyl alcohol. The formulations according to C5, and C6 were fluid, but cloudy in appearance in their concentrated form. C7 was the only formulation of C1 through C7 which was easily pourable having a water like viscosity, which was a clear solution and did not exhibit an offensive odor. The remaining formulations of the comparative examples improved over prior comparative formulations but did not uniformly meet expected blooming requirements of the concentrate compositions when 1 part was added to 64 parts of water at both 20° C. and 40° C. Some, showed good blooming performance at 40° C., but poor blooming behavior at 20° C.

The formulations according to E1 through E12 indicate formulations which in concentrate form are clear, but when diluted at ratios of 1 part to 64 parts of water at both 20° C. and 40° C., in the as mixed aqueous dilutions achieve the targeted loss of light transmittance of about 50% and more. Light transmittance values closer to zero indicate improved blooming behavior. The protocol for evaluating light transmittance is described more fully below.

Preparation of Cleaning Compositions

Cleaning testing was performed utilizing E2 described more fully on Table I, and cleaning compositions prepared from known commercially available cleaning products, which are described below.

Example Cleaning Composition E2

A cleaning composition according to the present invention was formed by mixing one part of cleaning concentrate formulation E2 described in Table 1, with 64 parts by weight of tap water at room temperature, approximately 20° C., and manually stirring the same to form a cleaning composition therefrom.

Comparative Cleaning Composition A

A cleaning composition was formed by forming an aqueous dilution of one part by weight of Mr. Clean (Regular, Lemon Scent), a commercially available cleaning concentrate (Procter & Gamble, Cincinnati Ohio) with 64 parts by weight of tap water at approximately 20° C. and subsequently manually stirring the same to form a uniform mixture.

Comparative Cleaning Composition B

A cleaning composition was formed by mixing one part of a commercially available cleaning formulation, PineSol® Cleaner (Lemon Scent) (Clorox Co., Oakland Calif.), a pine oil type cleaning concentrate, with 64 parts of water of tap water at room temperature, approximately 20° C., and manually stirring the same to form a cleaning composition therefrom.

Cleaning Evaluations

Cleaning evaluations were also performed in accordance with the testing protocol outlined according to ASTM D4488 A2 Test Method, which evaluated the efficacy of the cleaning compositions on masonite wallboard samples painted with wall paint. The soil applied was a greasy soil sample containing vegetable oil, food shortening and animal fat. The sponge (water dampened) of a Gardner Abrasion Tester apparatus was squirted with a 15 gram sample of a tested cleaning composition, and the apparatus was cycled 10 times. The evaluation of cleaning compositions was "paired" with one side of each of the test samples treated with a composition according to the invention, and the other side of the same sample treated with a comparative example's composition, thus allowing a "side-by-side" comparison to be made. Each of these tests were duplicated on 20 wallboard tiles and the results statistically analyzed and the averaged results reported on Table 3, below. The cleaning efficacy of the tested compositions was evaluated utilizing a Minolta Chroma Meter CF-110, with Data Processor DP-100, which evaluated spectrophotomic characteristics of the sample. The results are reported on Table 3, following.

TABLE 3

| | | percentage soil removal (%) | |
|---|---|---|---|
| Example Cleaning Comp. E2 | Comparative Cleaning Comp. A | 31.34% | 26.09% |
| Example Cleaning Comp. E2 | Comparative Cleaning Comp. B | 48.00% | 48.35% |

With respect to the results reported on Table 3 a value of "100" is indicative of a white (unsoiled) background, and a "0" value is indicative of a black background. As can be seen from the results of Table 3, the cleaning efficacy of the composition according to the invention generally provided superior results or were on parity with those of known art cleaning products.

Evaluation of Light Transmittance ("Blooming") of Formulations

Certain of the formulations described on Table 1 was evaluated to determine the degree of light transmittance, which conversely provided a measure of the opacity of each of the aqueous dilutions. The results of the light transmittance evaluation was determined as a percentage of light transmitted through a sample of a particular aqueous dilution wherein the transmission of a like sample of water is assigned a percentage of 100%. Testing was performed by preparing a 1:64 dilution of the example formulation:water, (tap water) after which the sample was mixed for 30 seconds and a transmittance reading was taken using a Brinkman model PC801 dipping probe calorimeter, which was set at 620 nm to determine the light transmission of each of the samples. Readings were taken at water temperatures of 20° C. and at 40° C. were evaluated, as well as the reference (pure tap water) sample used to calibrate the colorimeter to the reference 100% light transmission sample outlined above. The resulting determined values are reported in Table 1 which results provide an empirical evaluation of the degree of transparency of a diluted example formulation wherein 0% indicates complete opacity and 100% the transparency of the sample. Accordingly, a lower reported light transmittance value of a particular aqueous dilution provided a more desirable indication of the blooming characteristic of the particular aqueous dilution.

Evaluation of Antimicrobial Efficacy

Several of the exemplary formulations described in more detail on Table 1 above were evaluated in order to evaluate their antimicrobial efficacy against *Staphylococcus aureus* (gram positive type pathogenic bacteria) (ATCC 6538), and *Salmonella choleraesuis* (gram negative type pathogenic bacteria) (ATCC 10708). The testing was performed generally in accordance with the protocols outlined in "Use-Dilution Method", Protocols 955.14, 955.15 and 964.02 described in Chapter 6 of "Official Methods of Analysis", 16$^{th}$ Edition, of the Association of Official Analytical Chemists; "Germicidal and Detergent Sanitizing Action of Disinfectants", 960.09 described in Chapter 6 of "Official Methods of Analysis", 15$^{th}$ Edition, of the Association of Official Analytical Chemists; or American Society for Testing and Materials (ASTM) E 1054-91 the contents of which are herein incorporated by reference. This test is also commonly referred to as the "AOAC Use-Dilution Test Method".

As is appreciated by the skilled practitioner in the art, the results of the AOAC Use-Dilution Test Method indicates the number of test substrates wherein the tested organism remains viable after contact for 10 minutes with a test disinfecting composition/total number of tested substrates (cylinders) evaluated in accordance with the AOAC Use-Dilution Test. Thus, a result of "0/60" indicates that of 60 test substrates bearing the test organism and contacted for 10 minutes in a test disinfecting composition, 0 test substrates had viable (live) test organisms at the conclusion of the test. Such a result is excellent, illustrating the excellent disinfecting efficacy of the tested composition.

Results of the antimicrobial testing are indicated on Table 4, below. The reported results indicate the number of test cylinders with live test organisms/number of test cylinders tested for each example formulation and organism tested.

TABLE 4

| Example Formulation | *Staphylococcus aureus* | *Salmonella choleraesuis* |
|---|---|---|
| E3 | 1/60 | 1/60 |
| E4 | 0/60 | 1/60 |

From the results reported on Table 4, it is seen that the formulations according to E3 and E4 are appropriately categorized as a "broad spectrum" type disinfecting composition as it exhibits antimicrobial efficacy against two of the bacteria, *Staphylococcus aureus* and *Salmonella choleraesuis* in accordance with the AOAC Use-dilution Test method outlined above. From the foregoing it is to be understood that the compositions according to the invention provide excellent disinfecting benefits to hard surfaces, including hard surfaces. Such compositions in accordance with the present inventive teaching are particularly advantageously used against known bacteria commonly found in bathroom, kitchen and especially in hospital and health care environments. Still further, the efficacy of these compositions is believed effective against the polio virus as well. Such advantages clearly illustrate the superior characteristics of the compositions, which notwithstanding the relatively low content of volatile organic materials, surprisingly provide excellent antimicrobial benefits.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

We claim:

1. A blooming germicidal hard surface cleaning and disinfecting concentrate composition comprising:

0.1–10% wt. of a terpene-containing solvent which includes pine oil and d-limonene;

0.1–12% wt. of at least one organic solvent;

0.1–20% wt. of at least one non-ionic surfactant constituent which comprises at least one non-ionic surfactant having an HLB value of at least 10, and at least one non-ionic surfactant having an HLB value of at most 8;

a bloom-enhancing effective amount of at least one amphoteric surfactant selected from: alkylampho (mono)- and (di)-propionates;

optionally a further nonionic surfactant based on a $C_8$–$C_{18}$ primary alcohol ethoxylate which exhibits a cloud point of 20° C. in water;

a germicidally-effective amount of at least one cationic surfactant having germicidal properties; and, the balance, to 100% wt., of water.

2. The blooming, germicidal hard surface cleaning and disinfecting concentrate composition according to claim 1 wherein the organic solvent is selected from: $C_1$–$C_8$ alcohols, glycol ethers and glycols.

3. The blooming, germicidal hard surface cleaning and disinfecting concentrate composition according to claim 1 wherein:

the germicidal cationic surfactant is a quaternary ammonium compound.

4. The blooming, germicidal hard surface cleaning and disinfecting concentrate composition according to claim 3 wherein:

the quaternary ammonium compound is one or more according to the structure:

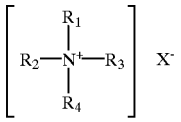

wherein;

at least one of $R_1$, $R_2$, $R_3$ and $R_4$ is selected from hydrophobic, aliphatic, aryl aliphatic or aliphatic aryl groups of from 6 to 26 carbon atoms, and any remaining $R_1$, $R_2$, $R_3$ and $R_4$ are hydrocarbons of from 1 to 12 carbon atoms, wherein any of $R_1$, $R_2$, $R_3$ and $R_4$ may be linear or branched and may include one or more ester or amide linkages; and, X is a salt-forming anionic radical.

5. The blooming, germicidal hard surface cleaning and disinfecting concentrate composition according to claim 3 wherein:

the quaternary ammonium compound is one or more according to the structure:

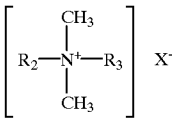

wherein $R_2$ and $R_3$ are the same or different $C_8$–$C_{12}$alkyl, or $R_2$ is $C_{12-16}$alkyl, $C_{8-18}$alkylethoxy, or $C_{8-18}$alkylphenolethoxy and $R_3$ is benzyl and X is a halide or a methosulfate radical.

6. The blooming, germicidal hard surface cleaning and disinfecting concentrate composition according to claim 1 wherein the amphoteric surfactant is an alkylampho(mono) propionate according to the according to the general structure:

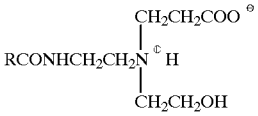

wherein R represents a $C_8$ to $C_{24}$ alkyl group.

7. The blooming, germicidal hard surface cleaning and disinfecting concentrate composition according to claim 1 wherein the amphoteric surfactant is an alkylampho(di) propionate according to either of the general structures:

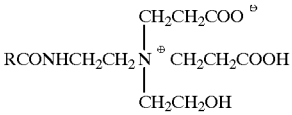

or

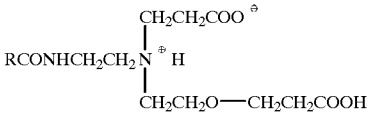

wherein R represents a $C_8$ to $C_{24}$ alkyl group.

8. A blooming, germicidal hard surface cleaning and disinfecting concentrate composition according to claim 1 which further comprises a 0.001–2.5% wt. of a linear $C_8$–$C_{18}$ primary alcohol alkoxylate.

9. An aqueous cleaning composition comprising blooming, germicidal hard surface cleaning and disinfecting concentrate composition according to claim 1 dispersed in water in a weight ratio of concentrate composition:water of from 1:0.1 to 1:1000.

10. A blooming, germicidal hard surface cleaning and disinfecting concentrate composition according to claim 1 which further comprises up to 10% by weight based on the total weight of the cleaning composition of one or more nonessential constituents selected from: coloring agents, light stabilizers, pH adjusters, pH buffering agents, foaming agents, further surfactants including anionic, cationic, nonionic, amphoteric and zwitterionic surfactants, and water softening agents.

11. A blooming, germicidal hard surface cleaning and disinfecting concentrate composition comprising:

0.1–10% wt. of a terpene-containing solvent which includes pine oil and d-limonene;

0.1–12% wt. of at least one organic solvent;

0.1–20% wt. of at least one non-ionic surfactant constituent which comprises at least one nonionic surfactant having an HLB, of greater than or equal to 10, and at least one non-ionic surfactant having an HLB value of less than or equal to 8;

a bloom-enhancing effective amount of at least one amphoteric surfactant selected from: alkylampho (mono)- and (di)-propionates;

optionally a further nonionic surfactant based on a $C_8$–$C_{18}$ primary alcohol ethoxylate which exhibits a cloud point of 20° C. in water;

a germicidally-effective amount of at least one cationic surfactant having germicidal properties; and, the balance, to 100% wt., of water, wherein the concentrate composition is characterized in that when the concentrate composition is diluted at a ratio of 1 part to 64 parts water at 20° C. or 40° C., a resultant mixture exhibits a light transmittance loss of at least 50%.

* * * * *